US009121266B2

(12) United States Patent
Sherman

(10) Patent No.: US 9,121,266 B2
(45) Date of Patent: Sep. 1, 2015

(54) BURST DISK-ACTUATED SHAPED CHARGES, SYSTEMS AND METHODS OF USE

(75) Inventor: Scott Sherman, Blackie (CA)

(73) Assignee: TRICAN WELL SERVICE LTD., Calgary (CA)

( * ) Notice: Subject to any disclaimer, the term of this patent is extended or adjusted under 35 U.S.C. 154(b) by 961 days.

(21) Appl. No.: 13/206,399

(22) Filed: Aug. 9, 2011

(65) Prior Publication Data

US 2012/0037366 A1 Feb. 16, 2012

Related U.S. Application Data

(60) Provisional application No. 61/372,385, filed on Aug. 10, 2010.

(51) Int. Cl.
*E21B 43/1185* (2006.01)
*E21B 34/06* (2006.01)
*E21B 43/263* (2006.01)

(52) U.S. Cl.
CPC ..... *E21B 43/11852* (2013.01); *E21B 34/063* (2013.01); *E21B 43/263* (2013.01)

(58) Field of Classification Search
CPC . E21B 43/117; E21B 43/116; E21B 43/1185; E21B 43/11; E21B 43/26; E21B 43/14; E21B 43/16; E21B 43/25
USPC ..... 175/2; 166/308.1, 177.1, 305.1, 281, 166/299, 271, 297, 55, 63
See application file for complete search history.

(56) References Cited

U.S. PATENT DOCUMENTS 5,632,348 A * 5/1997 Yunan ..... 175/4.54
6,446,727 B1 * 9/2002 Zemlak et al. ..... 166/308.1
7,096,954 B2 * 8/2006 Weng et al. ..... 166/308.1

* cited by examiner

*Primary Examiner* — Jennifer H Gay
*Assistant Examiner* — Caroline Butcher
(74) *Attorney, Agent, or Firm* — Goodwin Law

(57) ABSTRACT

One or more burst disks, for isolating downhole communication between a tubular and a hydrocarbon-bearing formation, are fit with a shaped explosive charge. Detonation of the shaped charge is initiated by the rupture of the burst disk. In a system for stimulating the formation, one or more sets of two or more shaped charge, enhanced burst disks are located at a location along the tubular corresponding to a selected interval for stimulation. The enhanced burst disks can be fit with a chamber of known pressure for establishing a known and significant pressure differential across the burst disk for enabling substantially simultaneous rupture at the selected interval.

21 Claims, 6 Drawing Sheets

BURST DISK-ACTUATED SHAPED CHARGES, SYSTEMS AND METHODS OF USE

CROSS-REFERENCE OF RELATED APPLICATIONS

This application claims the benefits under 35 U.S.C 119(e) of the U.S. Provisional Application Ser. No. 61/372,385, filed Aug. 10, 2010, which is incorporated fully herein by reference.

FIELD OF THE INVENTION

This invention relates to stimulation of subterranean formations. More specifically this invention relates to a system and method of performing stimulation treatments through the use of burst disks to pressure-actuate shaped, explosive charges for fracturing a subterranean formation.

BACKGROUND OF THE INVENTION

In the recovery of oil and gas from subterranean hydrocarbon formations, it is common practice to stimulate or fracture the hydrocarbon-bearing rock formation, providing or enhancing flow channels for oil and gas. These flow channels facilitate movement of the hydrocarbons into the wellbore so they may be produced from the wellbore. Without fracturing, many wells would not be economically viable.

In such fracturing operations, a fracturing fluid is injected down a wellbore penetrating the hydrocarbon formation. The fracturing fluid is forced down an annulus of the wellbore and into the formation strata or rock under pressure, forcing the rock to crack apart. Various methodologies are known for stimulating formations in horizontal or vertical open hole completion. One such methodology is a Source MultiStim™ system employing a multi-stage cased/open hole hybrid system that sets up wellbore isolation and frac points along an open hole section of the wellbore. A MultiStim™ frac liner and packers are run into an open hole for isolating a series of zones. Each zone can be stimulated in sequence accessed through a series of open/close sleeves in the liner. Each sleeve for each zone is shifted of actuated using a dropped ball to open a port to the formation. After a zone is fractured using high pressure fracturing fluid, a successive ball is dropped to actuate the next uphole sleeve and the process is repeated. At the completion of the stimulation, retrieval of all balls enables full bore access to the liner for production of hydrocarbons from the formation.

However, use of ball actuation can be problematic for several reasons including the need for retrieval of the balls using a retrieval string, ball loss or ball injection failure among others. Further, for fracturing treatment of tight rock formations, such as those found in the Cardium Formation of West Central Alberta, it can be difficult to cause an initial break down of the rock formation. Thus, in particularly hard rock formations, formation strata may not readily crack or fracture merely with the application of high pressure fluids. Such tight rock formations can require higher fracturing pressures than that which can be supplied by surface equipment of a conventional fracturing or completion string. In such cases, perforation guns are sometimes required in advance of treatment. Perforation guns require additional equipment and time consuming and expensive runs in and out of the wellbore.

Accordingly, there is still a need for reliable access to the formation and means for dealing with difficult formations.

SUMMARY OF THE INVENTION

In difficult formations accessed by a wellbore, such as tight rock formations, treatment can be enhanced by the use of shaped explosive charges for propelling a projectile into the rock. The detonation of the shaped charge is initiated by the rupture of burst disks fit to a tubular string used to access wellbore. One or more sets of two or more shaped-charge, enhanced burst disks are located at one or more locations along the tubular corresponding to selected intervals of the formation for stimulation. In embodiments, the enhanced burst disks can be fit with a pressure chamber of known pressure for establishing a known and significant pressure differential across the burst disk. Such a pressure chamber is located between the burst disk and the formation for ensuring a known and substantially constant pressure on the wellbore side of the burst disk, being unaffected by changing hydrostatic pressure in an external annulus between the tubular string and the wellbore. Known rupture pressure enables substantially simultaneous rupture of all burst disks of a set of burst disks, at a known tubular pressure, at the selected interval.

Generally, an enhanced burst disk is provided which, in one embodiment, is useable is systems for stimulating a subterranean formation having a wellbore formed therein which includes a tubular completion string having a wall with one more of the enhanced burst disks formed therein. The completion string forms an external annulus in the wellbore which is typically fit periodically with isolation elements for isolating intervals of the formation projected for stimulation. Burst disks temporarily block communication between a bore of the completion string and the formation. One or more of the burst disks are enhanced with shaped charges, hereinafter "enhanced burst disks". A well treatment tool, run into the completion string, has a treatment opening formed therein, straddled by two interval isolation devices and can be positioned such that the isolation devices straddle a set of burst disks positioned adjacent an isolated interval. The set of burst disks includes both enhanced burst disks and can include some non-enhanced burst disks. Treatment fluid introduced through the opening in the tool increases pressure within an annular space between the completion string and the treatment tool and between the two interval isolation devices to rupture the burst disks to access the formation. The bursting or rupture of burst disks establishes communication with the formation and causes actuation of the shaped charges of enhanced burst disks to direct a projectile at the formation. The fired projectile and the explosive charge can aid in reducing or lowering the frac initiation pressure required in tight rock formations. The treatment fluid then passes into the isolated annulus interval for stimulating the formation.

In one broad aspect an enhanced burst disk is provided for selectively accessing a subterranean formation through a port in a tubular. A burst disk is fit to the port for isolating the tubular from the formation. A shaped charge is positioned in the port between the burst disk and the formation. A detonator is operatively positioned for initiating detonation of the shaped charge, wherein when pressure in the tubular reaches a threshold pressure, the burst disk ruptures and actuates the detonator for initiating detonation of the shaped charge for directing a projectile into the formation and establishing communication through the port between the tubular and the formation.

The enhanced burst disk enables a system for stimulating one or more hydrocarbon containing one or more intervals of interest in a subterranean formation for producing oil and gas through a wellbore. The system comprises a completion string extending along the wellbore for accessing the one or more intervals of interest, the completion string having a wall for forming an external annulus with the wellbore, a bore and one or more stimulation locations spaced therealong and corresponding to an isolated and selected interval of the one or more intervals of interest, each stimulation location comprising, and two or more treatment ports through the wall and extending between the bore and the external annulus. Burst disks are provided corresponding to each treatment port, some of which are enhanced by positioning shaped charges radially outward from one or more of the burst disks. A detonator is provided for each shaped charge, the detonator actuable by rupture of the corresponding burst disk. A treatment tool is provided for running downhole in the bore of the completion string, the treatment tool having a uphole and a downhole isolation device and a treatment port therebetween, the uphole and downhole isolation devices sealing to the completion string and forming a treatment annulus therebetween, wherein when fluid discharged from the treatment port increases the fluid pressure in the treatment annulus to a threshold pressure, each of the burst disk ruptures, for establishing communication through the treatment ports and, for each enhanced burst disk, pressure actuating its corresponding shaped charge for penetrating the formation of the selected interval.

The enhanced burst disks and system enable the practice of a broad method aspect for stimulating one or more hydrocarbon-containing intervals of interest in a subterranean formation for producing oil and gas through a wellbore. The method comprises running a completion string into the formation, the completion string having a wall for forming an exterior annulus between the wall and the formation, a bore and one or more stimulation locations spaced therealong, each stimulation location comprising a least a set of burst disks disposed thereat, one or more of the burst disks of the set of the burst disks being enhanced, having a shaped charge positioned between the burst disk and the exterior annulus. One isolates the exterior annulus uphole and downhole of a selected interval of the one or more intervals of interest and runs a treatment tool into the completion string, the treatment tool having a uphole and downhole isolation devices and a treatment port therebetween. One positions the treatment tool adjacent a selected stimulation location of the one or more stimulation locations, corresponding to the selected interval, the uphole and downhole isolation devices straddling the selected stimulation location, sealing the bore thereabout and forming a treatment annulus and introduces fluid through the treatment port to increase a fluid pressure within the exterior annulus to a threshold pressure for rupturing the burst disks of the set of burst disks at the selected stimulation location for fluidly connecting the treatment annulus and the selected interval, each of the one or more ruptured, enhanced burst disks acting to initiate detonation of its shaped charge for penetrating the formation of the selected interval.

DETAILED DESCRIPTION OF THE INVENTION

Herein, apparatus and methods are disclosed for stimulating hydrocarbon production from a subterranean formation. In embodiments, a completion string is provided for running into a wellbore which implements burst disks in the string for selectively assessing the formation. For difficult or tight formations, the burst disks further implement a shaped explosive charge or shaped charge, triggered by rupture of the burst disk, for propelling a projectile into the formation for impacting the formation and initiating cracks in the hard rock strata.

Figure 1A:
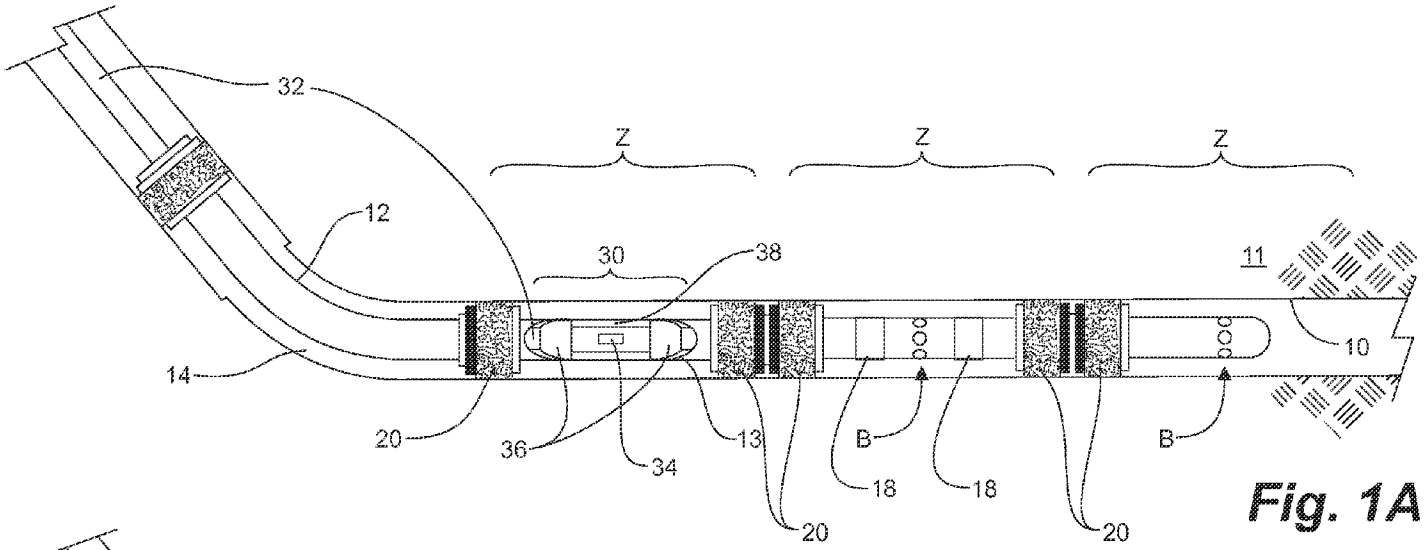
FIG. 1A is a cross-sectional view of a wellbore having a completion string disposed therein, the completion string having a partial cutout revealing a treatment tool therein and sets of burst disk assemblies, at least some of which are fit or enhanced with shaped charges in accordance with one embodiment.
Figure 1B:
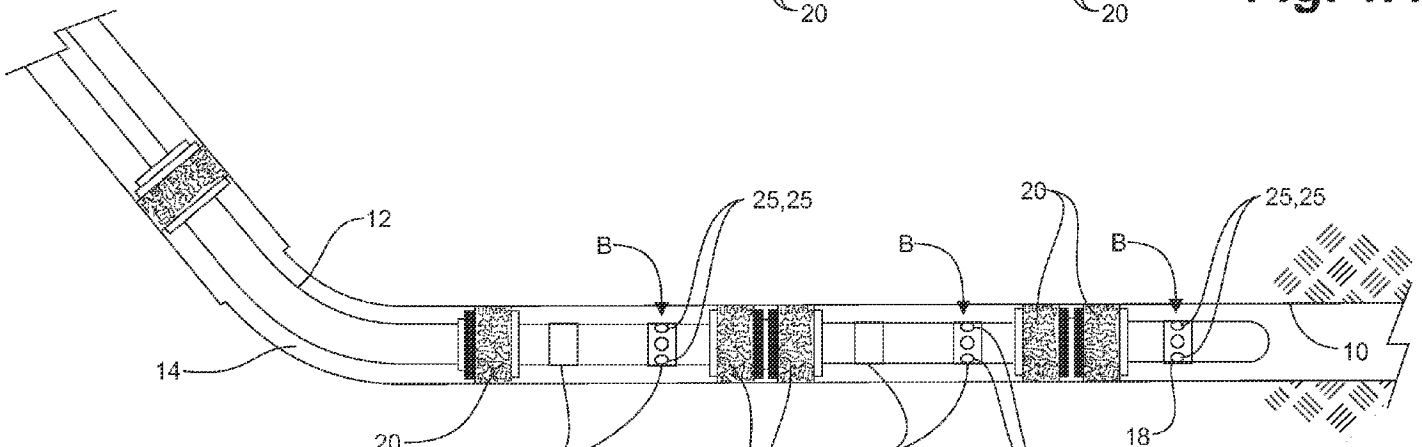
FIG. 1B is a cross-sectional of a wellbore and completion string having sets of burst disk assemblies, at least some of which are enhanced with shaped charges, and fit to collars of the completion string in accordance with another embodiment.

Turning to FIGS. 1A and 1B, a section of a wellbore 10 in a formation 11 is completed with a completion string 12 extending therealong. The completion string 12 accesses one or more zones of intervals Z of interest. An external annulus 14 is formed between the completion string 12 and the wellbore 10. The completion string 12 may be a wellbore casing, liner, or any other form of sectional or continuous tubulars. The completion string 12 may include collars 18 that join sections 17 of the completion string 12 together. The completion string 12 has a bore 13 for the introduction of treatment tools and treatment fluid and ultimately for the production of hydrocarbons from the stimulated formation 11.

In one embodiment, several intervals Z along the wellbore 10 and completion string 12 are shown isolated by external sealing devices or casing packers 20,20 . . . along the external annulus 14. The packers isolate the exterior annulus 14 uphole and downhole of a selected interval A of the one or more intervals of interest. Other known annular sealing devices can also be used. For example, the completion string 12 may be can be cemented into the wellbore, the cement blocking fluid communication between intervals Z.

For selective access to the external annulus 14 and the formation 11, the completion string 12 is fit with sets B of burst disks 25, a set B of burst disks 25 corresponding with each prospective interval Z for stimulation. As shown in FIGS. 1A and 1B, burst disks B can be built into individual sections 17 of the completion string 12 (FIG. 1A) or collars 18 between sections 17 (FIG. 1A). Rupture of the burst disks 25 of the selected set B, establishes communication between the bore 13 and the formation 11.

In embodiments in which the completion string 12 is cemented into the wellbore, burst disks 25, at risk of exposure to cement, can be covered by an expendable shield or protective substance, such as a mastic, supported in the wall and spaced radially outward from the burst disk to prevent cement from sealing the burst disks B. Regardless of the application of a shield or protective mastic, the external annulus 14 is unobstructed allow cement to flow continuously along the entire length of the completion string 12.

During treatment, treatment or fracturing fluid penetrates through the layer of cement to the formation 11 (See SPE 107730, April 2007, "Novel Technology Replaces Perforation and Improves Efficiency During Multiple Layer Fracturing Operations", by Rytlewski, G. and Lima, J.).

The burst disks 25 are pressure-actuated to rupture through application of pressurized fluid, such as the treatment fluid, in the bore 13 of the completion string 12, applied at a set B of burst disks 25. Fluid is applied using a treatment tool 24.

FIG. 1A shows a partial cutout of the completion string 12 to reveal a bottom hole assembly (BHA) comprising a treatment tool 30 conveyed on treatment tubing 32 that has been inserted into the bore 13 of the completion string 12. The tubing 32 may be coiled tubing or jointed pipe, and the tubing 32 and tool 30 are run downhole to, and into, the completion string 12 to the intervals Z. The tool 30 can be any conventional tool for use in these types of operations for accessing portions of the completion string 12. Two or more treatment tools can be spaced along a tool conveyance string for limiting repositioning of the BHA. The tool 30 includes a treatment opening or port 34 straddled by at least two isolation devices, 36,36; such as packers, cups or other sealing means for sealing the completion string bore 13 thereabout. A tool 30 using packer cups as isolation devices 36 can include an equalization valve to facilitate running in and tripping out without flaring the uphole and downhole cups resulting in premature wear or damage thereto Uphole and downhole isolation devices 36,36 are positioned to straddle a selected interval Z. Treatment fluid is injected under pressure through the treatment port 34 and into a treatment annulus 38 between the tool 24, the completion string 12, and extending between the isolation devices 36,36. The treatment fluid flowing through the port 34 remains confined in the treatment annulus 38 and is applied to the selected sets B of burst disks 25.

The form of burst disks 25 can be the conventional type used in the prior art, for example, burst disks supplied by Benoil Services Ltd, United Kingdom. If conventional burst disks are used, then they can be installed into the completion string 12 in a conventional manner.

Figure 3:
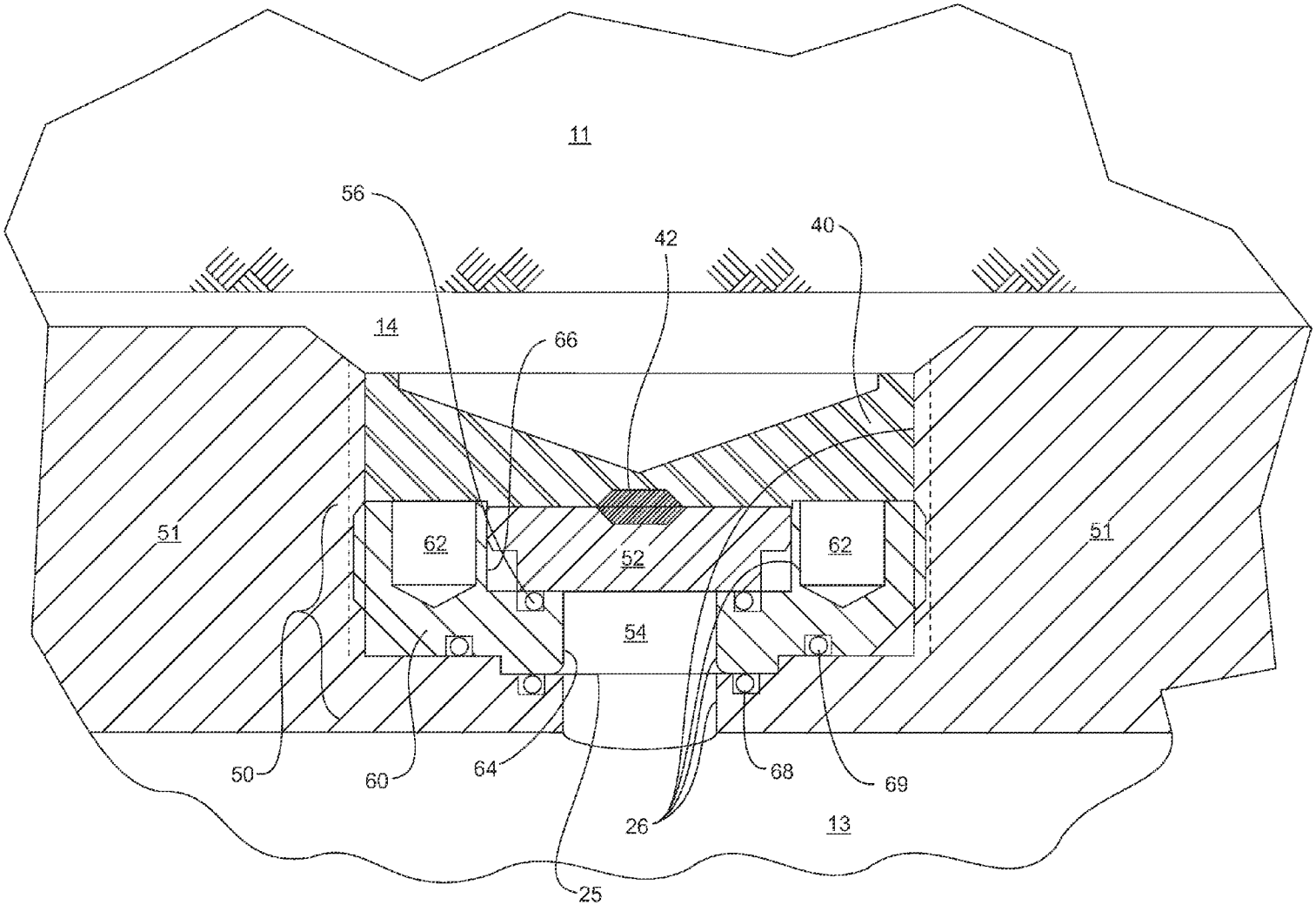
FIG. 3 is an enlarged view cross-sectional view of an embodiment of a burst disk assembly of FIG. 2.
Figure 4A:
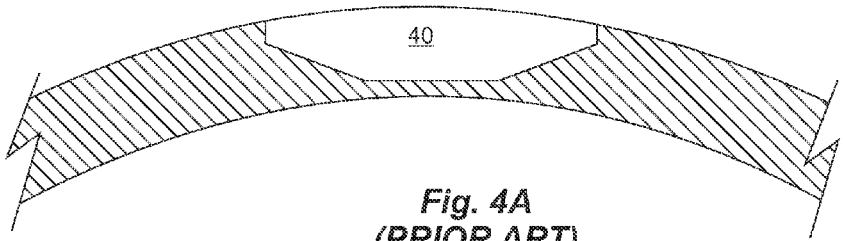
Fig. 4A (PRIOR ART)
FIGS. 4A through 4G are a series of partial cross-sections of prior art shaped charges typically employed in prior art perforating tools.
Figure 4B:
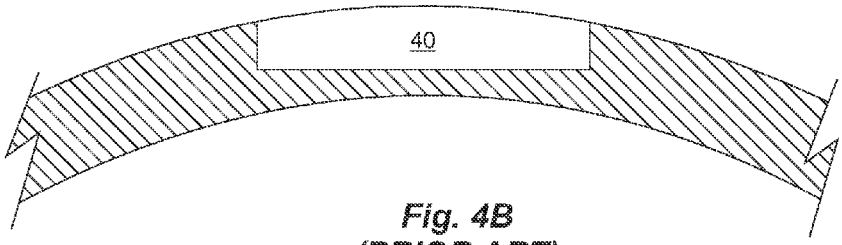
Fig. 4B (PRIOR ART)
Figure 4C:
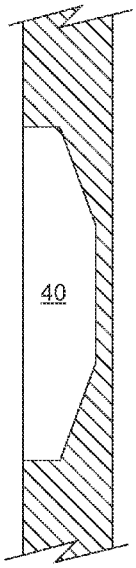
Fig. 4C (PRIOR ART)
Figure 4D:
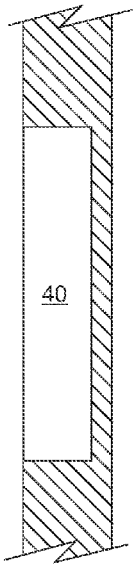
Fig. 4D (PRIOR ART)
Figure 4E:
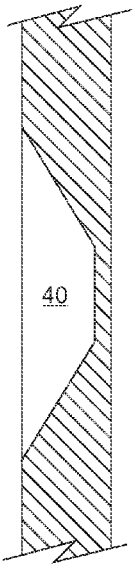
Fig. 4E (PRIOR ART)
Figure 4F:
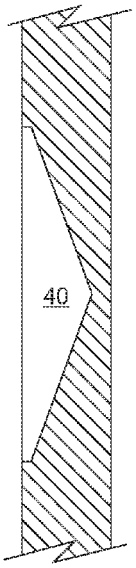
Fig. 4F (PRIOR ART)
Figure 4G:
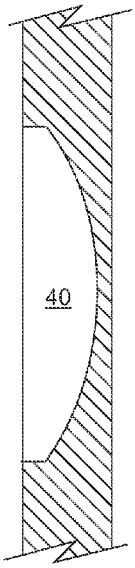
Fig. 4G (PRIOR ART)
Figure 5:
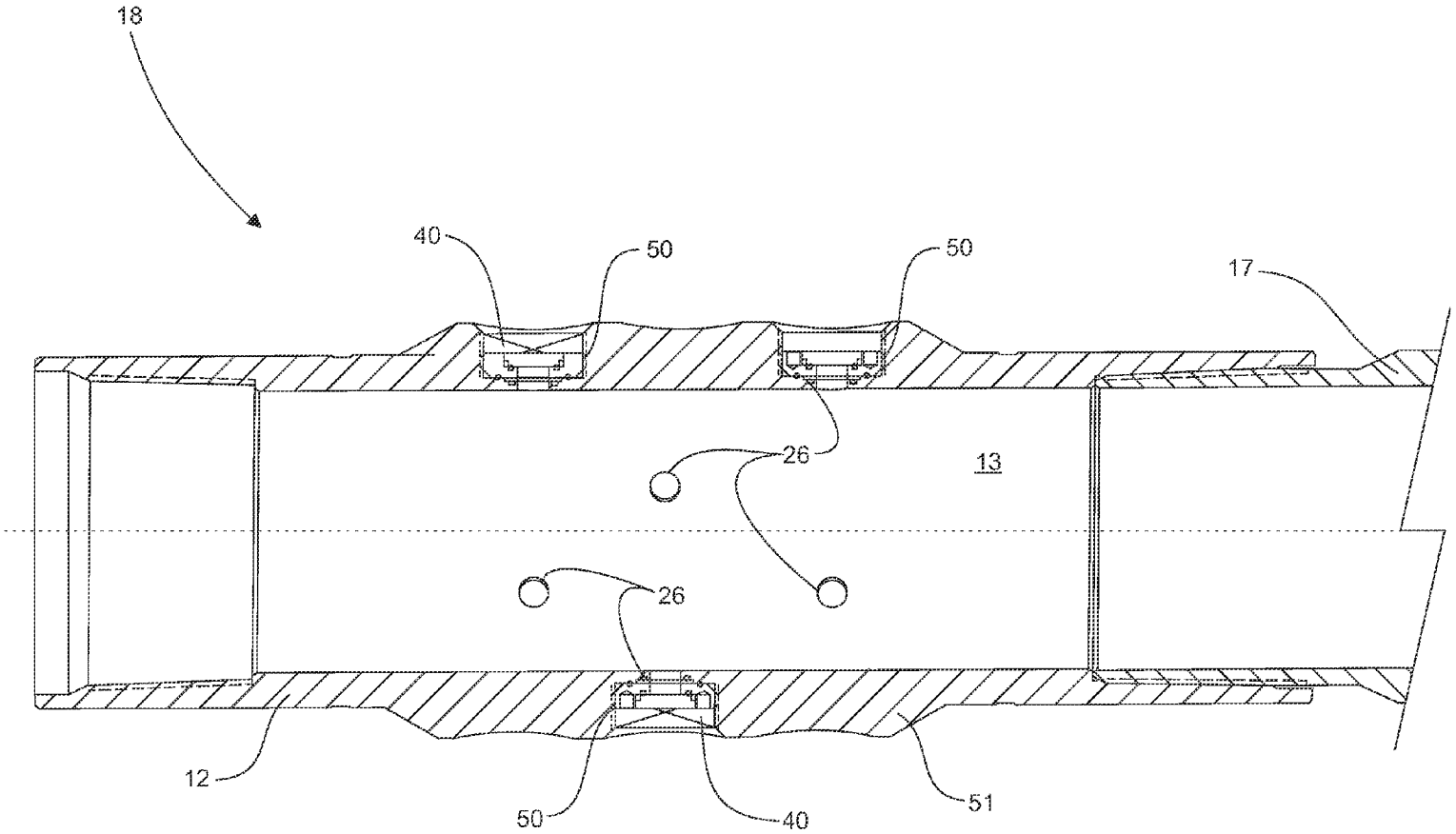
FIG. 5 is a close up of a collar of a completion string for better illustrating the burst disk assemblies of a set of assemblies, at least some of which incorporate shaped charges.

One or more of the burst disks 25 are fit or enhanced with shaped explosive charges, or simply, shaped charges 40. A completion string 12 may be fit with some burst disks 25 of a set B being enhanced or fit with shaped charges, and other of the burst disks 25 of the set B being without shaped charges 40. Rupture of the burst disk initiates the detonation of the shaped charge 40. The physical action of the structure of the rupturing burst disk or the resulting pressure surge, once ruptured, can actuate or initiate detonation. As set forth in U.S. Pat. No. 4,629,001 to Miller et al. (Halliburton) and in U.S. Pat. No. 4,509,604 to Upchurch (Schlumberger), it is known to use movement of a firing structure such as a pin to impact a primer assembly or percussion cap which in turn ignites primer cord which fires a perforation gun. The firing pin can be manipulated using a pressure-actuated piston arrangement. Herein, as shown in FIG. 3, a firing structure or detonator 42, such as any one of a percussion cap alone or percussion cap and primer cord can be incorporated between the burst disk 25 and the shaped charge 40. In any event, actuation of the detonator 42 and initiation of detonation of the shaped charge 40 is dependent upon rupture of the associated burst disk 25. One form of burst disk 25 is disclosed herein which can further include means for ensuring substantially simultaneous rupturing of a plurality of like burst disks 25.

In an embodiment, the burst disks 25 can be formed in wall of the completion string 12 or wall of the collar 18 themselves rather than being off-the-shelf disks that are installed into the wall. As described in Applicant's co-pending, published PCT application, WO 2010/148494, an in-wall burst disk 25 can be formed by boring a recess partway through the wall of the completion string 12 or collar 18 to create a thinned wall defining a burst disk 25. The recess does not penetrate through the wall. For fitting of a protective material, insert or cap, the wall can have a stepped bore; the recess forming the thinned wall and a counter-bore of greater diameter sized to accept the protective component. A person of ordinary skill in the art would appreciate that the order of boring the recess and counter-bore does not matter. Other embodiments of burst disk arrangements are disclosed herein.

More particularly, as detailed in FIG. 3, substantially all burst disks 25 can be designed to reliably rupture effectively or substantially simultaneously at about a threshold pressure P, as described in Applicant's co-pending, U.S. application Ser. No. 12/999,940, published as US 2012-0111566-A1 and now issued as U.S. Pat. No. 8,863,850, the entirety of which is incorporated herein by reference. Each burst disk 25 is housed in a burst port assembly 50 which is secured in a burst port 26 formed in the wall 51 of the completion string 12 of collar 18. Burst disks assemblies 50 are arranged in sets B,B . . . , according to their function, such as those at one particular interval along the wellbore 10. As all of the burst disks 25 of each burst disk assembly 50 rupture at substantially the same threshold pressure P, multiple ports are made available, substantially simultaneously, for maximized flow of treatment fluid therethrough.

As extracted in part therefrom, an embodiment of a burst disk 25 can be part of a burst disk assembly 50. As in conventional apparatus, each burst disk 25 has a thickness and material properties which determine a differential pressure across the burst disk 25 at which the burst disk will rupture. The burst disk 25 can be manufactured from stainless steel or any other suitable material. The burst disk 25 is circular in shape and has a diameter between ¼ inch and 1 inch when used with a completion string 12 of suitable material and thickness. Preferably, the diameter of the burst disk is 7⁄16 inches or ⅝ inches. However, a person of ordinary skill in the art would understand that the shape and diameter of the burst disk 25 may vary. The thickness, diameter and material of the burst disk 25 determines the magnitude of burst pressure. For example, according to one embodiment, a burst disk diameter of about ⅝ inches and a completion string wall thickness of 0.01 inches results in a burst pressure of about 3,000 psi to about 4,000 psi using L-80 casing. The burst disk 25 is preferably made of alloy, however the burst disk 25 can be made of any suitable material that could withstand the relevant pressures. For example, the burst disk can be made of plastic or other metals.

For ensuring the behaviour of one burst disk assembly 50 is the same as each other burst disk assembly 50 in a set B, a cap 52 is releasably fit to the port and spaced above the burst disk 25 for forming a chamber 54 therebetween. Typically the chamber 54 is at about atmospheric pressure. The cap 52 can be peened in place to entirely cover the area of the port or held in place by other means. For example, the cap 52 can be press fit or held in place by means of an O-ring or some other similar method. The protective cap 52 creates a tight fit against the rim of the port 26 such that fluid is prevented from flowing between the annulus 14 and the bore 13 of the completion string 12. The pressure in the chamber 54 remains substantially constant regardless of the change in pressure outside the chamber 54. The port 26 remains closed prior to rupture.

Capping the port 26 with a protective cap 52 serves several purposes. The cap 52 ensures that the burst disks 25 burst with like pressure regardless of the hydrostatic pressure outside the completion string 12 and therefore can be designed to rupture substantially simultaneously regardless in pressure variation upon commencement of rupturing and flow through open ports 26. In the prior art, if one burst disk B were to rupture before the others, then fluid flow out of that first ruptured burst disk and port could adversely affect the actuation pressure and reliability of the pressure-actuated rupturing of the remaining burst disks. Further, herein, the cap 52 isolates the burst disks from any rise in the exterior annulus 14 and rupturing of any burst disks 25 from the outside in. The cap 52 can be fit with a seal or O-ring 56 to further ensure no leak path into the chamber.

The chamber 54 remains at a substantially fixed and known pressure, such as about atmospheric pressure, when the completion string 12 is first run into the wellbore 10. Thus, each of the two or more burst disks 25 is unaffected by the variable hydrostatic pressure of fluids in the annulus 14 and remains sensitive to pressure changes in the bore 13 of the completion string 12. As the pressure in the chamber 54 can be set at surface, such as at atmospheric pressure, the resulting differential pressure downhole, between the bore 13 and the chamber 54, is both known and elevated compared to prior art arrangements in which the hydrostatic pressure in the annulus 14 diminishes the effective differential pressure across the conventional burst disk. Therefore, where the pressure in the chamber 54 is now significantly less than the hydrostatic pressure in the annulus 14, the burst disks 25 are more reactive to controlled pressure in the bore 13. In other words, the differential pressure at which the burst disk 25 will rupture is determined by the pressure in the bore 13. As the chamber 54 has a known pressure, all of the burst disks 25 rupture together and reliably as pressure in the bore 13 of the casing 10 increases to the threshold pressure P. The pressure in the bore 13 is determined by the pressure of the treatment fluid therein. The cap 52 is releasably supported outward of the burst disk 25 such that when the burst disk ruptures, the flow of treatment fluid therethrough into the chamber releases or displaces the cap 52, initiating detonation of the shaped charge 40 where implemented, and creating the open port 26 to the annulus 14.

In the embodiment shown in FIG. 3, each burst port assembly 50 is mounted in the completion string 12, casing or casing collar 18 and comprises the burst disk 25 which is adjacent the bore 13. The burst disk assembly 50 is retained to the wall 51 and within the burst port 26 by a retainer ring 60. The retainer ring 60 can be threadably engaged in the burst port 26. Wrench-receiving slots 62 are formed in the retainer ring 60 for ease of threading the burst disk assembly 50 into the burst port 26. Further, the retainer ring 60 has a stepped bore, forming a stepped extension of port 26, having a first bore 64 in the chamber 54 adjacent the burst disk 25 and a second, larger retainer bore 66 for releasably supporting the cap 52. The cap 52 is fit, peened or press-fit into the second bore 66 of the retainer ring 60 for forming the chamber 54 between the cap 52 and the burst disk 25. Seals 68, such as O-rings, seal between the burst disk 25 and the wall 51. Further, seals 69 are provided to seal between the retainer ring 60 and the wall 51. Seals 56 seal between the retainer ring 60 and the cap 52. Thus, the chamber 54 is sealingly maintained at the known pressure until the burst disk 25 ruptures. When the pressure within the bore 13 reaches the threshold pressure P, the burst disk 25 ruptures and the cap 52 is displaced from the retainer ring 60, opening the rupture port 26 through the burst disk assembly 50. Treatment fluid flowing through the bore 13 is permitted to pass through the rupture port 26 and into the annulus 14.

Figure 2:
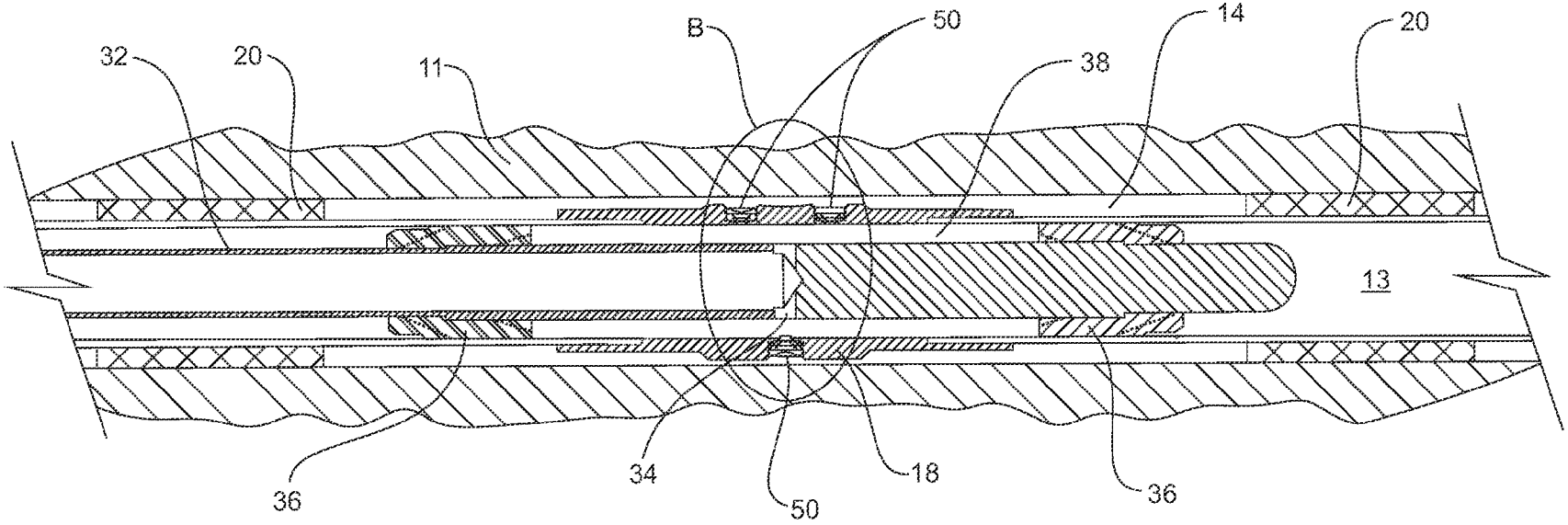
FIG. 2 is a cross-sectional view of a wellbore and completion string having a set of burst disk assembly in a collar.
Figure 6:
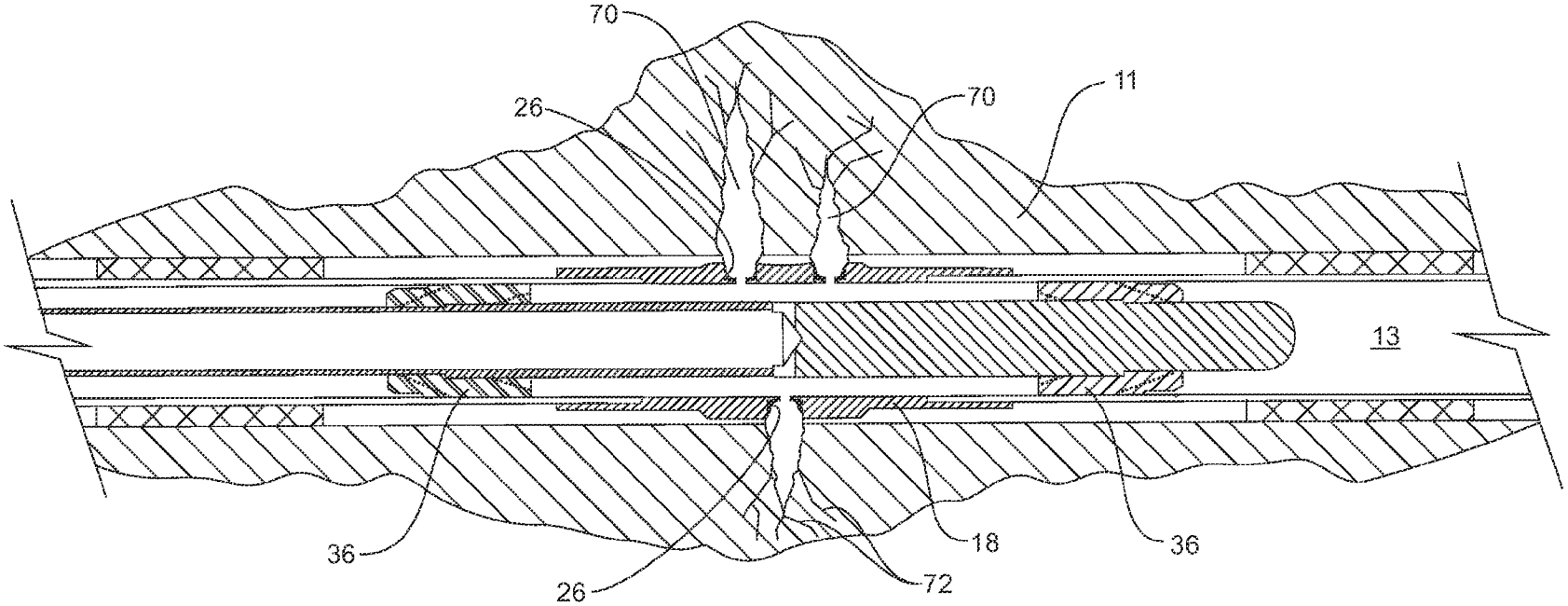
FIG. 6 is a cross-sectional view of a wellbore and completion string having formed perforation tunnels and fractures in a tight rock formation aided by the detonation of shaped charges actuated by the rupturing of burst disks.

As shown in FIGS. 6 and 2, one or more of the burst disk assemblies 50 are enhanced by including a shaped charge 40, located radially outward of the burst disk assembly 50 and adjacent the annulus 14. In an embodiment of such an enhanced burst disk assembly, the shaped charge 40 includes the firing structure or detonator 42 for incorporating a primer assembly, percussion cap, firing pin or other means for detonating the shaped charge. In another embodiment the cap 52, or cap and shaped charge 40 together, incorporate the detonator 42.

As shown in FIGS. 4A to 4G, various forms of shaped charges 40 are commonly used in the oil and gas industry for perforating oil or gas bearing subterranean formations. A discussion of the various forms is as disclosed U.S. Pat. No. 6,497,285 to Walker of Halliburton Energy Services, Inc. A shaped charge is an explosive device which typically comprises three parts: a metal case, a metal liner and a specific amount of explosives sandwiched between the case and liner. Upon detonation of the explosives, the liner becomes a high velocity metal projectile or jet travelling at a speed typically between 1000-9000 meters per second (mps) followed at a lower speed by a slug. In cased wellbores, the jet is used to punch a hole through a well casing and into the formation to create an initial perforation, establishing a communication channel between the formation and the wellbore. In uncased wellbores, the jet and slug impact the hard rock strata to create a perforation and fractures.

Optionally, a displaceable, yielding protective substance, such as mastic, may be used to cover the cap 52 of a burst disk assembly, or the shaped charge. This embodiment is discussed in Applicant's co-pending, published PCT application, WO 2010/148494. In a shaped charge, the mastic can substantially fill an outer portion of the shaped charge 40, adjacent the annulus 14 to ensure the outermost component is not dislodged or damaged, such as during transport or insertion into the wellbore 10. When the burst disk 25 ruptures, the treatment fluid flowing through the burst disk assembly 50 displaces the cap 52 and the protective substance. When the burst disk 25 of an enhanced burst disk assembly 50 ruptures, detonating the shaped charge 40, residual material of the shaped charge and protective substance can be displaced by the treatment fluid flowing therethrough.

Operations

Referring to FIGS. 1A and 6, conventionally, an interval Z of the wellbore 10 to be fractured is isolated by conventional methods. The spacing between intervals Z,Z can differ depending on the wellbore however, typically, they may be spaced about every 100 meters. Hydraulic isolation in the exterior annulus can be achieved by having the completion string 12 either cemented into position or by having external packers or other annular sealing device 20,20 . . . running along the longitudinal length of the completion string 12. Cement, external packers and annular sealing devices provide hydraulic isolation along the annulus 14 formed by the completion string 12 and the open hole of the wellbore 10.

In an embodiment, before running into the wellbore 10, the completion string 12 is fit with a set B of burst disk assemblies 50,50, . . . at each location along the completion string that will correspond with an interval Z. Each set B of the burst disk assemblies is fit with like burst disks 25 or assemblies 50 for rupturing at a like pressure. A set B of burst disks may be installed in the string 12 at a selected collar 18 corresponding with the interval Z of interest.

Where burst disk assemblies 50 are fit with a cap 52 and pressure chamber 54, the chamber pressure is initially set. Simply, by installing the caps 52 at surface, the chamber can be set to atmospheric pressure. One or more of the burst disks 25 of the burst disk assemblies 50 is enhanced by fitting with a shaped charge 50.

The completion string 12 is run into the wellbore 10 and positioned with the sets B of burst disk assemblies located adjacent intervals Z to be treated. Thereafter, the well treatment tool 30 is conveyed down the bore 13 of the completion string 12. The tool 24 is conveyed on a treatment tubing 32, such as a coiled tubing or jointed pipe. The isolation devices 36,36 are positioned to straddle the sets B of burst disk assemblies 50,50 . . . adjacent the interval of interest Z. Treatment fluid is pumped under pressure through the treatment tubing 32 and ejected from ports 34 in the tool 30 between the isolation devices 36,36 and into a treatment annulus 38 formed in the bore 13 between the isolation devices 36,36 and the completion string 12. The treatment fluid causes a sufficient increase in pressure at the area of the burst disk assemblies 50 so as to rupture the burst disks 25 of the set B of burst disk assemblies 50. The treatment fluid can be pumped at a pressure between about 100 psi and about 20,000 psi to rupture the disks B. Preferably, pressure is applied at about 100 psi to about 10,000 psi. More preferably, pressure is applied at about 3,000 psi to about 4,000 psi.

As shown in FIG. 6, for burst disk assemblies 50 fit with shaped charges 40, exceeding the threshold pressure results in at least one ruptured, enhanced burst disk for initiating and detonation of its respective shaped charge 40. The bursting or rupture of each enhanced burst disks 25 causes actuation of its respective shaped charges 40 to form a projectile. The shaped charge 40 directs the projectile (not shown) radially outwardly to strike the tight rock formation, forming a perforation tunnel 70 and initiating fractures 72. The projectile and the explosive charge can aid in reducing or lowering the frac initiation pressure required in tight rock formations. The treatment fluid then passes through the ruptured burst disk assemblies 50, into the isolated annulus 14 and reaches the formation 11 for stimulation including fracturing.

For burst disk assemblies 50 without shaped charges, the treatment fluid passes through the ruptured burst disk assemblies 50 and reaches the formation 11 which has been affected by the shaped charges from other of the assemblies 50.

Herein, since the sets B of burst disk assemblies 50 are straddled by isolation devices 36,36 and the area to be stimulated is further isolated by packers 20,20 or cement, stimulation can begin anywhere along the completion string 12 where burst disks 25 and shaped charges 40 are located. There need not be any pre-defined order of treatment. For example, stimulation can occur downhole first and then moved up hole, or in the reverse order, or stimulation can start partway down the wellbore and then proceed either up or downhole.

Therefore, following treatment, the treatment tubing, and hence the tool 24, can be moved uphole or downhole, repositioning to straddle another of subsequent set B of burst disk assemblies 50,50 . . . wherein the completion string comprises at least one subsequent stimulation location. The treatment tool is repositioned adjacent a subsequent selected stimulation location of the completion string corresponding to a subsequent selected interval Z. The uphole and downhole isolation devices 36,36 straddle the subsequent selected stimulation location, sealing the completion string bore 13 and forming a subsequent treatment annulus 38 at a subsequent set B of burst disks 25,25 . . . . Thereafter, treatment fluid is introduced through the treatment port 34 to the threshold pressure P for rupturing the subsequent set B of burst disks, each of the at least one ruptured, enhanced burst disk acts to initiate detonation of its shaped charges for penetrating the formation of the selected interval Z. The threshold pressure may be the same or different for each subsequent selected interval Z.

Each set B of burst disks assemblies 50 can be actuated treated independently as successive treatments are isolated from each other by isolation devices 36,36. As such, each isolated interval of formation can also be treated separately. As the interval Z is isolated by packers 20,20 or cement, and the treatment annulus 38 is small, pressure builds within the completion string 12 very quickly. The operation is further simplified because, unlike methods of prior art, each burst disk assembly can be identical and be set for the same actuation pressure threshold. Furthermore, the same pressure can be applied for each treatment at each interval Z, wherein each set B of burst disk assemblies 50 at each interval can be set for the same threshold pressure P.

As taught in Applicant's corresponding U.S. application Ser. No. 12/999,940, published as US 2012-0111566-A1, now issued as U.S. Pat. No. 8,863,850, incorporated herein by reference in its entirety, a treatment tool need not be used where all of the burst disks in the completion string are to be ruptured in a single operation. To accomplish rupturing of all of the burst disks, a fluid pressure in the bore of the completion string in increased to the threshold pressure. As one of skill will appreciate, the burst disks, whether enhanced with shaped charges or otherwise, are cause to rupture as taught therein. If enhanced with shaped charges, following rupturing of the burst disk, the shaped charge is detonated as taught herein.

In embodiments of this invention, isolation devices are not needed; treatment fluid is pumped down the completion string from surface and all the burst ports can be subject to the treatment fluid pressure simultaneously, and will also rupture simultaneously. The treatment fluid will then flow into the hydrocarbon bearing formation from the ports at the same time.

In another embodiment of this invention, burst disks mounted in collars with different burst pressure thresholds can be set such that a series of burst disks rupture in a staggered manner according to various fluid pressures being applied. The completion string is inserted in the wellbore and ready for stimulation operations. Burst pressures at each burst disk can increase uphole with the burst disk at the toe of the wellbore set with the lowest burst pressure. Treatment fluid is then pumped down the completion string to rupture the burst disk and continuously pumped to stimulate the first interval located at the toe of the wellbore. Once the first interval is stimulated, it is isolated from fluid communication with the remainder of the completion string. This isolation can be achieved by setting a sealing device between the burst disks in the first interval and the next interval to be stimulated. The next interval can then be stimulated. The sealing device can be a packer or other device known in the art. Another way to isolate the interval is by pumping frac balls or particulate material down the completion string, which block the passageway though the ruptured burst disks. The next interval would be situated uphole from the first zone. The steps are then repeated for stimulating the next interval and subsequent interval. The sequence need not start at the distal end of the completion string, the burst disks can be ruptured in any order. During wellbore completion operations, it is sometimes necessary it insert an array of different tools in the wellbore to perform different functions. The most cost effective way to insert these tools in a wellbore is typically on a wireline for easy insertion and removal of the tool. In order to insert wireline borne tools in a horizontal wellbore, the ports in the toe of the wellbore are ruptured. This provides communication with the formation and allows wireline tools to be pumped down the wellbore, which would be impossible if the distal end of the wellbore was sealed.

The method can be practiced if the wellbore is cemented with only a completion string present and to pump treatment fluid through the completion string; with a treatment string present and to pump treatment fluid through the treatment string; or to pump through the annulus between the completion string and the treatment string.

The embodiments of the invention for which an exclusive property or privilege is claimed are defined as follows:

1. A method for stimulating one or more hydrocarbon-containing intervals of interest in a subterranean formation for producing oil and gas through a wellbore, comprising:

running a completion string into the wellbore, the completion string having a wall for forming an exterior annulus between the wall and the formation, a bore and one or more stimulation locations spaced therealong, each stimulation location comprising a least one set of burst disk assemblies disposed thereat, each burst disk assembly having a burst disk in a port extending through the wall, the burst disk positioned adjacent the bore of the completion string, and a cap spaced therefrom and releaseably fit to the port for forming a sealed pressure chamber therebetween at a constant pressure, wherein one or more of the burst disk assemblies further comprises a shaped charge and detonator located in the port between the cap and the formation;

isolating the exterior annulus at a selected interval of the one or more intervals of interest;

running a treatment tool into the completion string and forming a treatment annulus therebetween, the treatment tool having uphole and downhole isolation devices for sealing in the treatment annulus and a treatment port therebetween;

positioning the treatment tool adjacent a selected stimulation location of the one or more stimulation locations corresponding to the selected interval, the uphole and downhole isolation devices sealing the treatment annulus thereabout;

flowing fluid through the bore of the treatment tool to flow into the treatment port to the isolated treatment annulus for increasing a fluid pressure therein to a threshold pressure for rupturing all of the burst disks in the at least one set of burst disk assemblies at the selected stimulation location for displacing the caps therefrom for fluidly connecting the bore with the treatment annulus and initiating detonation of the shaped charges for forming perforations in the formation at the selected interval.

2. The method of claim 1 wherein the completion string comprises at least one subsequent stimulation location, the method further comprising:

re-positioning the treatment tool adjacent a subsequent, selected stimulation location of the completion string corresponding to the subsequent selected interval, the uphole and downhole isolation devices sealing the treatment annulus at the subsequent selected interval and straddling a subsequent set of burst disk assemblies thereat; and introducing fluid through the treatment port to increase the fluid pressure within the treatment annulus to the threshold pressure for rupturing all of the burst disks in the subsequent set of burst disk assemblies, and wherein one or more burst disk assemblies of the set of the burst disk assemblies has a shaped charge and detonator located in the port between the cap and the formation, the rupturing of the burst disk displacing the caps for fluidly connecting the bore with the treatment annulus and to initiate detonation of the shaped charge for forming perforations in the formation at the subsequent selected interval.

3. The method of claim 1 further comprising:

cementing the exterior annulus for isolating the one or more intervals of interest.

4. The method of claim 1, after rupturing the burst disks and displacing the caps, further comprising:

flowing a treatment fluid through the treatment tubing for delivery through the ruptured burst disk to the perforations for treating the formation.

5. An enhanced burst disk assembly for selectively accessing a subterranean formation through a port in a tubular, comprising;

a burst disk adapted to be fit to the port;

a cap adapted to be sealingly and releasably engaged within the port and spaced from the burst disk for forming a sealed chamber therebetween, the chamber being at a constant pressure, the burst disk rupturing at a threshold pressure for establishing fluid communication with the chamber for releasing and displacing the cap therefrom for establishing communication therethrough;

a shaped charge, adapted to be positioned in the port beyond the cap; and a detonator adapted to be positioned in the port for operatively initiating detonation of the shaped charge at a threshold pressure for forming perforations in the formation.

6. The burst disk of claim 5 wherein the detonator is positioned between the burst disk and the shaped charge.

7. The burst disk assembly of claim 5 wherein each burst disk assembly further comprises:

a retainer ring adapted to be secured in the port for retaining at least the burst disk and the cap therein.

8. The burst disk of claim 7 wherein the detonator is located between the shaped charge and the cap.

9. A system for stimulating one or more hydrocarbon-containing intervals of interest in a subterranean formation for producing oil and gas through a wellbore, comprising:

a completion string extending along the wellbore for accessing the one or more intervals of interest, the completion string having a wall, forming an external annulus with the wellbore, a bore and one or more stimulation locations spaced therealong corresponding to the one or more intervals of interest, each stimulation location comprising;

two or more ports extending through the wall between the bore and the external annulus;

a burst disk positioned in each port adjacent the bore;

a cap sealing engaged with the port and spaced from the burst disk toward the formation for forming a chamber therebetween, the chamber being maintained at a constant pressure;

a shaped charge positioned in at least one of the two or more ports positioned radially outwardly from the cap; and a detonator actuable upon rupturing of the burst disk; and a treatment tool for running downhole in the bore of the completion string and forming a treatment annulus therebetween, the treatment tool having an uphole and a downhole isolation device thereon and a treatment port straddled therebetween, the uphole and downhole isolation devices actuable to seal the treatment annulus at a selected stimulation location, wherein when fluid, flowing through the treatment tool, is discharged from the treatment port, pressure in the treatment annulus is caused to increase to at least a threshold pressure causing the burst disk to rupture, establishing fluid communication through the port in the wall; and, wherein at least one of the two or more ports further comprises the shaped charge and the detonator, causing detonation of the shaped charge for forming perforations in the formation at the selected interval.

10. The system of claim 9 wherein each completion string comprises one or more collars, the two or more ports being formed through the wall of the collars.

11. The system of claim 9 wherein each burst disk is part of a burst disk assembly.

12. The system of claim 11 wherein each burst disk assembly further comprises:

a retainer ring securing the burst disk in the port; and wherein the cap is supported in the retainer ring.

13. The system of claim 9 wherein each burst disk at the stimulation location has the same threshold pressure.

14. The system of claim 9 wherein the treatment tool comprises two or more treatment tools spaced along a tool conveyance string.

15. The system of claim 9 wherein the treatment tool is conveyed from the selected stimulation location to a subsequent stimulation location using a tool conveyance string.

16. A system for stimulating one or more hydrocarbon-containing intervals of interest in a subterranean formation, for producing oil and gas through a wellbore extending therethrough, comprising:

a completion string extending along the wellbore for accessing the one or more intervals of interest, the completion string having a wall forming an external annulus with the wellbore, a bore and one or more stimulation locations spaced axially therealong, the external annulus being cemented for isolating the one or more intervals of interest, each stimulation location comprising:

a set of burst disk assemblies positioned between the bore and the external annulus, each assembly having a burst disk positioned adjacent the bore of the completion string; and a cap spaced from the burst disk and forming a chamber therebetween, the chamber being maintained at a constant pressure;

a shaped charge positioned between the cap and the external annulus in at least one burst disk assembly of the set of burst disk assemblies; and a detonator operatively connected to the shaped charge; and a treatment tool for running in the bore of the completion string, the treatment tool having a bore, an uphole and a downhole isolation device thereon for sealing a treatment annulus formed between the treatment tool and the completion string at a selected interval of the one or more intervals of interest, and a treatment port therebetween, wherein when fluid run through the bore of the treatment tool is discharged from the treatment port into the treatment annulus, pressure therein is increased to a threshold pressure for rupturing all of the burst disks in the set of burst disk assemblies against the constant pressure and displacing the caps therefrom for establishing communication therethrough and for actuating the detonator for detonating the shaped charge for forming perforations in the cemented annulus and the formation therebeyond at the selected interval.

17. The system of claim 16 further comprising:

flowing treatment fluid through the bore of the treatment tool for delivering fluid through the ruptured burst disks to the perforations for treating the formation therebeyond.

18. The system of claim 16 wherein each of the burst disk assemblies further comprises an expendable shield positioned at the port for preventing the cement sealing therein.

19. The system of claim 18 wherein the expendable shield is a mastic.

20. The system of claim 16 wherein the burst disks in the set of burst disk assemblies at each stimulation location have the same threshold pressure.

21. A system for stimulating one or more hydrocarbon-containing intervals of interest in a subterranean formation, for producing oil and gas through a wellbore extending therethrough, comprising:

a completion string extending along the wellbore for accessing the one or more intervals of interest, the completion string having a wall forming an external annulus with the wellbore, a bore and one or more stimulation locations spaced axially therealong, the external annulus being cemented for isolating the one or more intervals of interest, each stimulation location comprising:

a set of burst disk assemblies positioned between the bore and the external annulus, each assembly having a burst disk positioned adjacent the bore of the completion string; and a cap spaced from the burst disk and forming a chamber therebetween, the chamber being maintained at a constant pressure;

a shaped charge positioned between the cap and the external annulus in at least one burst disk assembly of the set of burst disk assemblies; and a detonator operatively connected to the shaped charge;

wherein when a pressure in the bore of the completion string adjacent the burst disks reaches a threshold pressure, all of the burst disks in the set of burst disk assemblies ruptures against the constant pressure in the chamber, displacing the caps therefrom for establishing communication therethrough and for actuating the detonator for detonating the shaped charge for forming perforations in the cemented annulus and the formation therebeyond at the selected interval.

* * * * *